US007537250B1

(12) United States Patent
Gustafson

(10) Patent No.: US 7,537,250 B1
(45) Date of Patent: May 26, 2009

(54) CABINET CHILD SAFETY LOCK

(76) Inventor: Jerome Gustafson, 11044 Zumbrota Ct., Blaine, MN (US) 55449

( * ) Notice: Subject to any disclaimer, the term of this patent is extended or adjusted under 35 U.S.C. 154(b) by 0 days.

(21) Appl. No.: 11/617,455

(22) Filed: Dec. 28, 2006

(51) Int. Cl.
*E05C 19/00* (2006.01)
*E05C 9/10* (2006.01)

(52) U.S. Cl. ..... 292/300; 292/259 R; 292/288; 292/296; 292/338; 292/DIG. 65; 312/216; 312/333; 49/394

(58) Field of Classification Search ..... 292/92, 292/259 R, 278, 288, 289, 300, 251, 291, 292/296, 304, 338, 339, DIG. 11, DIG. 61, 292/DIG. 65, 176, 202, 210, 213, 203; 16/293, 16/295; 312/216, 333; 49/394, 395
See application file for complete search history.

(56) References Cited

U.S. PATENT DOCUMENTS

| | | | | |
|---|---|---|---|---|
| 3,017 | A | 3/1843 | Blake et al. | |
| 14,773 | A | 4/1856 | Moulton | |
| 27,265 | A | 2/1860 | Bligh | |
| 105,409 | A | 7/1870 | Arnold | |
| 107,139 | A | 9/1870 | Westcott | |
| 187,530 | A | 2/1877 | Hasselbach et al. | |
| 227,062 | A | 4/1880 | Weis | |
| 284,615 | A | 9/1883 | Conklin | |
| 300,926 | A | 6/1884 | Watrous | |
| 382,086 | A | 5/1888 | Herrick | |
| 646,239 | A | 3/1900 | Schuyler | |
| 838,437 | A * | 12/1906 | McDaniel | 312/351 |
| 909,525 | A * | 1/1909 | Benton | 292/259 R |
| 1,085,277 | A | 1/1914 | Lund | |
| 1,437,083 | A | 11/1922 | Arnold | |
| 1,765,614 | A | 6/1930 | Roberts et el. | |
| 1,800,715 | A * | 4/1931 | Clausen | 220/326 |
| 2,569,941 | A | 10/1951 | Mastrangelo et al. | |
| 2,661,974 | A * | 12/1953 | Zehnder | 292/258 |
| 4,667,992 | A * | 5/1987 | Roden, Jr. | 292/259 R |
| 5,387,018 | A * | 2/1995 | Pinkerton | 292/259 R |
| 5,664,815 | A * | 9/1997 | Kornder | 292/288 |
| 5,685,048 | A * | 11/1997 | Benoit | 24/16 PB |
| 6,471,310 | B2 * | 10/2002 | Montagna | 312/223.2 |
| 6,560,925 | B1 * | 5/2003 | Rice | 49/141 |
| 6,604,453 | B2 | 8/2003 | Niese | |
| 6,619,706 | B2 | 9/2003 | Mackie | |
| 6,644,698 | B1 * | 11/2003 | Christensen | 292/259 R |
| 6,705,652 | B2 * | 3/2004 | Engel | 292/259 R |
| 6,802,429 | B1 | 10/2004 | Wildman | |
| 7,052,053 | B2 | 5/2006 | Hall et al. | |
| 7,261,329 | B1 * | 8/2007 | Julian et al. | 292/84 |
| 2007/0246951 | A1 * | 10/2007 | Thompson | 292/210 |

* cited by examiner

*Primary Examiner*—Carlos Lugo

(57) ABSTRACT

A child safety lock to selectively secure cabinet drawers and doors by using tie-wraps to mount a horizontally oriented base standoff onto the front rail of the cabinetry in a manner that won't hinder opening and closing the related doors and drawers. At least one spring-loaded latch member is pivotally disposed on the base standoff above a notched out section. The latch member stays frictionally engaged in the horizontal position due to the bias provided by spring-loaded pivot point when access is desired. To restrict access therein, the adult simply turns the latch member to the vertical position to block the door/drawer wherein the spring bias pulls it into the notched out section thereby necessitating the more complex action of simultaneously pulling and turning the latch member to allow access thereto.

9 Claims, 10 Drawing Sheets

CABINET CHILD SAFETY LOCK

BACKGROUND OF THE INVENTION

1. Field of the Invention

The present invention relates generally to child safety locks and, more specifically, to a child safety lock for cabinets that is designed to be retrofit to existing cabinetry without the use of tools or modification thereof.

Cabinet drawers and doors pose a constant hazard for toddlers and young children who are very curious and try to get into everything they can reach. A child could be severely injured by reaching up and pulling out a silverware drawer and having it fall on them, just to mention one such danger. Parents are aware of this and trying to secure cabinet drawers and doors is a vital part of child-proofing a house. Unfortunately, existing methods are cumbersome and often entail drilling the cabinetry or the insertion of screws therein.

The present invention provides a means for rapidly installing a child safety lock to selectively secure cabinet drawers and doors by using tie-wraps to mount a horizontally oriented base standoff onto the front rail of the cabinetry in a manner that won't hinder opening and closing the related doors and drawers. At least one spring-loaded rotative latch member is pivotally disposed on the base standoff above a notched out section. The latch member stays frictionally engaged in the horizontal position due to the bias provided by spring-loaded pivot point when access is desired. To restrict access therein, the adult simply turns the latch member to the vertical position to block the door/drawer wherein the spring bias pulls it into the notched out section thereby necessitating the more complex action of simultaneously pulling and turning the latch member to allow access thereto.

Removal of the present invention simply entails cutting the tie-wraps. The non-invasive nature of the present invention also provides portability to quickly childproof someone else's house when visiting others since no damage such as screw holes are present upon removal.

2. Description of the Prior Art

There are other child safety devices designed for cabinet doors and drawers. Typical of these is U.S. Pat. No. 3,017 issued to Blake et al. on Mar. 21, 1833.

Another patent was issued to Moulton on Apr. 29, 1856 as U.S. Pat. No. 14,773. Yet another U.S. Pat. No. 27,265 was issued to Bligh on Feb. 28, 1860. Another was issued to Arnold on Jul. 19, 1870 as U.S. Pat. No. 105,409 and still yet another was issued on Sep. 6, 1870 to Westcott as U.S. Pat. No. 107,139.

Another U.S. Pat. No. 187,530 was issued to Hasselbach et al. on Feb. 20, 1877. Another was issued to Weis on Apr. 27, 1880 as U.S. Pat. No. 227,082 and still yet another was issued on Sep. 11, 1883 to Conklin as U.S. Pat. No. 284,615

Another patent was issued to Watrous on Jun. 24, 1884 as U.S. Pat. No. 300,926. Yet another U.S. Pat. No. 382,086 was issued to Herrick on May 1, 1888. Another was issued to Schuyler on Mar. 27, 1900 as U.S. Pat. No. 646,239 and still yet another was issued on Jan. 27, 1914 to Lund as U.S. Pat. No. 1,085,277.

Another patent was issued to Arnold on Nov. 28, 1922 as U.S. Pat. No. 1,437,083. Yet another U.S. Pat. No. 1,765,614 was issued to Roberts, et al. on Jun. 24, 1930. Another was issued to Mastrangelo et al. on Oct. 2, 1951 as U.S. Pat. No. 2,569,941 and still yet another was issued on Aug. 12, 2003 to Niese as U.S. Pat. No. 6,604,453.

Another patent was issued to Mackie on Sep. 16, 2003 as U.S. Pat. No. 6,619,706. Yet another U.S. Pat. No. 6,802,429 was issued to Wildman on Oct. 12, 2004 and still yet another was issued on May 30, 2006 to Hall, et al. as U.S. Pat. No. 7,052,053.

U.S. Pat. No. 3,017

Inventor: Philos Blake et al.

Issued: Mar. 21, 1843

The employment of a spring in combination with the other parts of a, plate turn button, to make friction on the plate, and thereby to prevent the button from turning too freely, as herein set forth.

U.S. Pat. No. 14,773

Inventor: Elisha P. Moulton

Issued: Apr. 29, 1856

Constructing turn buttons or fasteners in the manner above described, the stem and head of the button being in one piece, and having a collar at its end that prevents the button from being withdrawn from its frame by the strain brought on the head of the button by the door which it secures, the stem of the button having a square part that is pressed against by a spring in the manner and for the purpose hereinbefore described.

U.S. Pat. No. 27,265

Inventor: G. M. Bligh

Issued: Feb. 28, 1860

The employment, in combination with the can A, of the swivel-catches E, when constructed and arranged as herein set forth, for the purpose specified.

U.S. Pat. No. 105,409

Inventor: Steven D. Arnold

Issued: Jul. 19, 1870

The socket g and stud d, between the bar a and plate f, for connecting said bar a and plate f, in combination with the plate b upon which the bar a swings, the parts being constructed so that the attaching plate b and f will be in line with each either, and, the bar a stand out from the shutter, as and for the purposes specified.

U.S. Pat. No. 107,139

Inventor: Henry P. Westcott

Issued: Sep. 6, 1870

A butter-pail convenient to handle, with a cover that can be securely fastened and readily removed, and which will not become unduly fastened by the expansion of the wood when standing in a cellar, or unduly loose by the shrinkage of the wood when standing in a cellar, or unduly loose by the shrinkage of the wood when standing in the sun or other dry place:

U.S. Pat. No. 187,530

Inventor: Ferdinand Hasselbach et al.

Issued: Feb. 20, 1877

As an improvement in cigar-boxes, the combination of hinged front section or wall B of a cigar-box with the side walls C, provided with pivoted oblong clasps D near the front corners, locking into recesses of the front wall, substantially as and for the purpose set forth.

U.S. Pat. No. 227,082

Inventor: Wendelin Weis

Issued: Apr. 27, 1880

The box A, having cover B. provided with circular opening C, having mouth D on its lower edge and beveled rim d, in combination with the elongated button E, having rounded ends e, substantially as and for the purposes set forth.

U.S. Pat. No. 284,615

Inventor: Theodore F. Conklin

Issued: Sep. 11, 1883

The combination, in a trunk-catch, of the hasp A, elastic, or provided with a spring, pressing it to the plates x y, and provided with socket-hole b and with notch a, the hasp being pivoted to plate x and oscillating laterally on its pivot d, the catch B, and the post or lug C, which, engaging with the curved notch a and with the edge of the hasp above and below the notch, in turn permits the lateral movement of the hasp upon detaching it from the catch; and upon closing the trunk guides the hasp to an automatic engagement of its socket-hole b with the catch B, substantially as described.

U.S. Pat. No. 300,926

Inventor: Filmore M Watrous

Issued: Jun. 24, 1884

This invention relates to a device by which a box-cover may be readily secured or detached with special reference to boxes designed to receive coffins or caskets. It is now almost the universal custom to place the coffin or casket in a strong box preparatory to its being placed in the grave, and this placing of the casket in the box occurs after the funeral ceremony, and generally at the grave. The cover as heretofore applied has been secured by numerous screws. The securing of the cover onto the box after the casket has been placed therein requires considerable time, and is always a hurried effort on the part of the persons employed to do it.

U.S. Pat. No. 382,086

Inventor: Frank J. Herrick

Issued: May 1, 1888

The object of this improvement is the production of a button for doors, closets, and the like which shall have a concealed cushion or buffer of rubber or the like exerting a constant friction between the button and the surface to which the button is attached, to the end that the button shall not be accidentally misplaced as regards its rotary position.

U.S. Pat. No. 646,239

Inventor: Daniel Schuyler

Issued: Mar. 27, 1900

The invention comprises a pivoted locking button provided with a concealed stop and being provided with means for holding the button normally in given position. Preferably one end of the button is heavier than the other, so that gravity will hold the button normally vertical. The stop is preferably arranged to allow the rotation of the button throughout a quadrant only and to allow the long axis of the button to stand horizontally and perpendicularly at the opposite limits.

U.S. Pat. No. 1,085,277

Inventor: Frank T. Lund

Issued: Jan. 27, 1914

In combination with a casing and adjacent movable part, a pivot carried by the casing, a button comprising a base portion rotatable upon said pivot and formed with s an upwardly and forwardly extending spring part slidable upon said pivot.

U.S. Pat. No. 1,437,083

Inventor: Thomas A. Arnold

Issued: Nov. 28, 1922

A fastening device for boxes or containers, comprising a channel-shaped member having the lower base: flange extended at one end to form an attaching means, the end of said member opposite from the attaching end being under-cut to farm an overhhanging portion, said flange and said overhanging portion being provided with perforations to receive suitable locking means.

U.S. Pat. No. 1,765,614

Inventor: Glenn Roberts et al.

Issued: Jun. 24, 1930

This invention relates to new and improved storm door and window hardware or fastenings. The principal object of the invention resides in the provision of a new and improved storm door or window fastener which is so constructed as to be flush with the surfaces of the storm sash or below the same whereby the entire storm window and fastenings may be changed and stored in flatwise contacting relation and are completely out of the way at all times so as to fail to interfere with raising or lowering conventional permanent windows.

U.S. Pat. No. 2,569,941

Inventor: Faustina Mastrangelo et al.

Issued: Oct. 2, 1951

An outer frame member forming a window opening, a window sash fitting said opening, said frame and sash being provided with complementary shallow recessed portions which, when juxtaposed, form a single recess with a circular peripheral wall extending to the surface of the frame and sash, one of said recessed portions being larger than the other, and means for detachably fastening said frame and sash in assembled position comprising an elongated fastening member having a length substantially equal to the diameter of the combined recess and fitting wholly within said recess, said fastening member being pivoted within the larger of said recessed portions, and its pivot being slightly eccentric in the direction of the larger recess.

U.S. Pat. No. 6,604,453

Inventor: Ursula Niese

Issued: Aug. 12, 2003

A steam pressure cooker, includes a pot with a horizontal pouring rim, a lid for closing the pot, and an elastic seal positioned between the lid and the pot. At least two moveable clamps are arranged peripherally in even spaced-apart relationship, for clamping the lid and the pouring rim, when the steam pressure cooker is closed, and clearing the pouring rim, when the steam pressure cooker is opened. The clamps and the lid are covered by a cap which supports a handle comprised of two handle parts, which are respectively connected to the cap and the lid. Actuation of the handle effects a coaxial rotation of the cap relative to the lid between two end positions, whereby in one end position the clamps are moved outwards, until the pouring rim is cleared. A tip clamping mechanism secures the cap relative to the lid in the end positions.

U.S. Pat. No. 6,619,706

Inventor: Stuart Mackie

Issued: Sep. 16, 2003

A cabinet earthquake latch assembly designed to be attached on a cabinet inner surface and a back surface of a cabinet door. The cabinet earthquake latch assembly includes a door arm, a cam and a strike. When in use, the door arm is attached to the cabinet door, the cam is rotatably attached to the door arm and the strike is attached to the cabinet inner surface. The cam and strike are configured and attached to the door arm and cabinet inner surface such that the cam collides with the strike when the cabinet door is being initially opened at least a predetermined speed (e.g., a speed generated in an earthquake). This collision causes the cam to rotate from a rest position and then to become lodged against the strike in a rotated position, thus preventing further opening of the cabinet door.

U.S. Pat. No. 6,802,429

Inventor: Andrew Eric Wildman

Issued: Oct. 12, 2004

A steam kettle lid assembly includes an elongated arm movable between an up position and a down position. A steam kettle lid includes central portion non-rotatingly attached to the arm in a manner which permits floating movement of the lid for proper seating on a kettle opening, but which also prevents a condensate rim on a bottom portion of the lid from rotating out of its functional position.

U.S. Pat. No. 7,052,053

Inventor: Matthew Hall, et al.

Issued: May 30, 2006

A load floor latch for securing a first closure member to a second closure member. The latch is opened by actuating a handle and a pawl supported on the housing is pivoted away from a keeper on the second closure member by the actuation of the pawl by the handle which is biased to the closed position. The pawl is biased to the closed position. The pawl projects through an opening on the latch housing and also has a pawl projection which is guided during pivoting of the pawl by a portion of the exterior surface of the housing of the latch.

While these securing devices may be suitable for the purposes for which they were designed, they would not be as suitable for the purposes of the present invention, as hereinafter described.

SUMMARY OF THE PRESENT INVENTION

A primary object of the present invention is to provide a child safety lock to prevent small children from accessing cabinet doors and drawers.

Another object of the present invention is to provide a child safety lock that may be non-invasively retrofit to existing cabinets.

Yet another object of the present invention is to provide a child safety lock having a horizontal base standoff and a pair of rotative latch members disposed thereon, wherein said latch members prohibit the opening of cabinet doors and drawers thereabove and below when disposed in the vertical position and allows for the unimpeded movement thereof when horizontally disposed.

Still yet another object of the present invention is to provide a child safety lock wherein the latch members are secured to the base standoff with spring-loaded pivot points.

Another object of the present invention is to provide a child safety lock wherein the pivot points are secured in vertically oriented notched sections of the base standoff.

Yet another object of the present invention is to provide a child safety lock wherein said spring-loaded pivot points provide a bias urging the latch members towards the base standoff thus frictionally engaging them thereagainst while in the horizontal position preventing the inadvertent rotation thereof and unimpeded access to the related cabinet doors and drawers.

Still yet another object of the present invention is to provide a child safety lock wherein the spring-loaded pivot points urge the latch members into the notched sections when placed in the vertical position where they are retained until the spring bias is overcome by the user pulling thereon and rotating simultaneously thereby requiring a compound movement that would be difficult for a small child to perform.

Additional objects of the present invention will appear as the description proceeds.

The present invention overcomes the shortcomings of the prior art by providing a child safety lock to selectively secure cabinet drawers and doors by using tie-wraps to mount a horizontally oriented base standoff onto the front rail of the cabinetry in a manner that won't hinder opening and closing the related doors and drawers. At least one spring-loaded latch member is pivotally disposed on the base standoff above a notched out section. The latch member stays frictionally engaged in the horizontal position due to the bias provided by spring-loaded pivot point when access is desired. To restrict access therein, the adult simply turns the latch member to the vertical position to block the door/drawer wherein the spring bias pulls it into the notched out section thereby necessitating the more complex action of simultaneously pulling and turning the latch member to allow access thereto.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
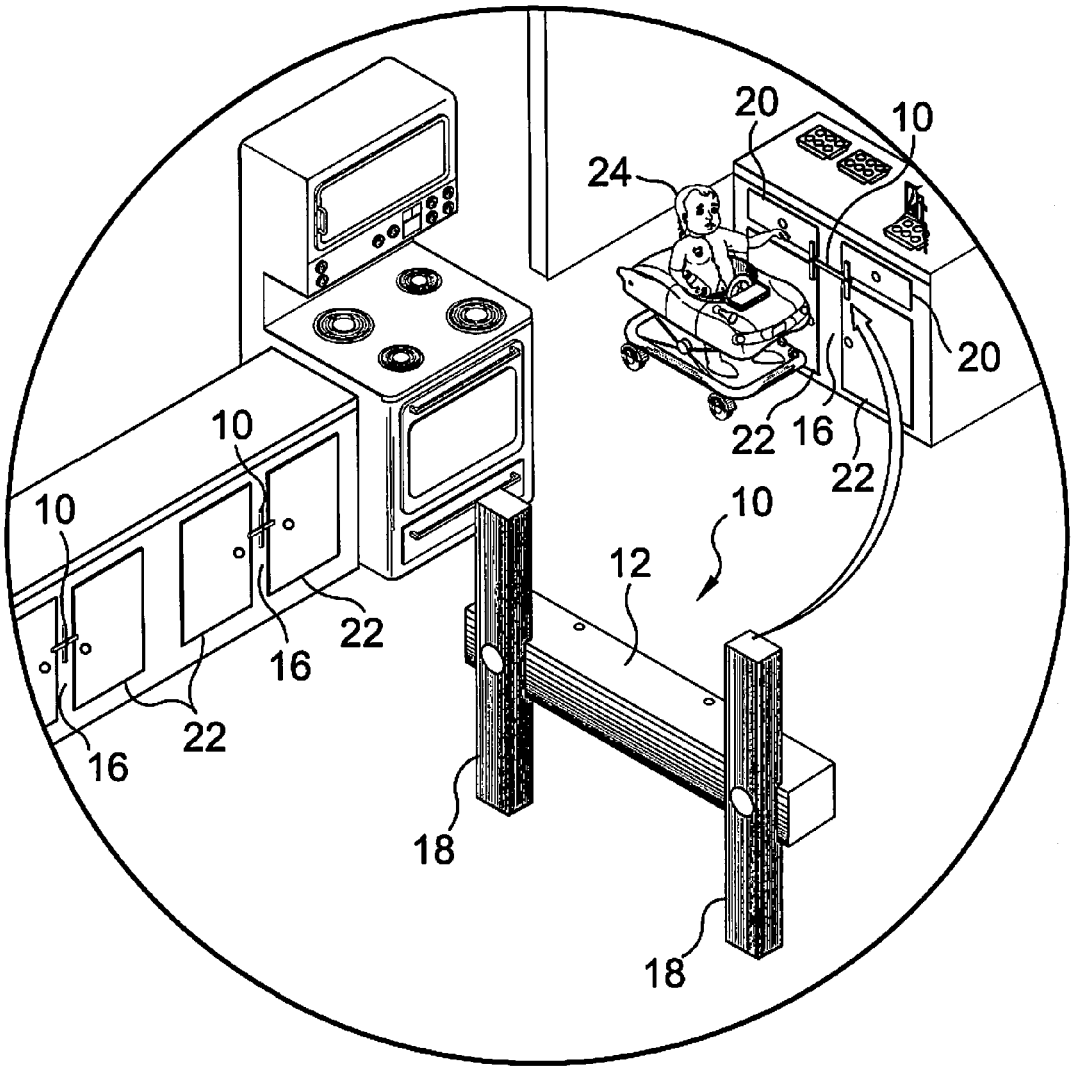
FIG. 1 is an illustrative view of the present invention in use.

Turning now descriptively to the drawings, in which similar reference characters denote similar elements throughout the several views, the Figures illustrate the Childproof Safety Lock for Cabinetry of the present invention. With regard to the reference numerals used, the following numbering is used throughout the various drawing figures.

10 Childproof Safety Lock for Cabinetry of the present invention

12 base standoff

14 tie wrap straps

16 cabinet frame

18 locking member

20 cabinet drawer

22 cabinet door

24 child

26 apertures of 12

28 spring loaded pivot point

30 retaining notch

32 spring member

34 screw

36 recess

38 cap

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Figure 2:
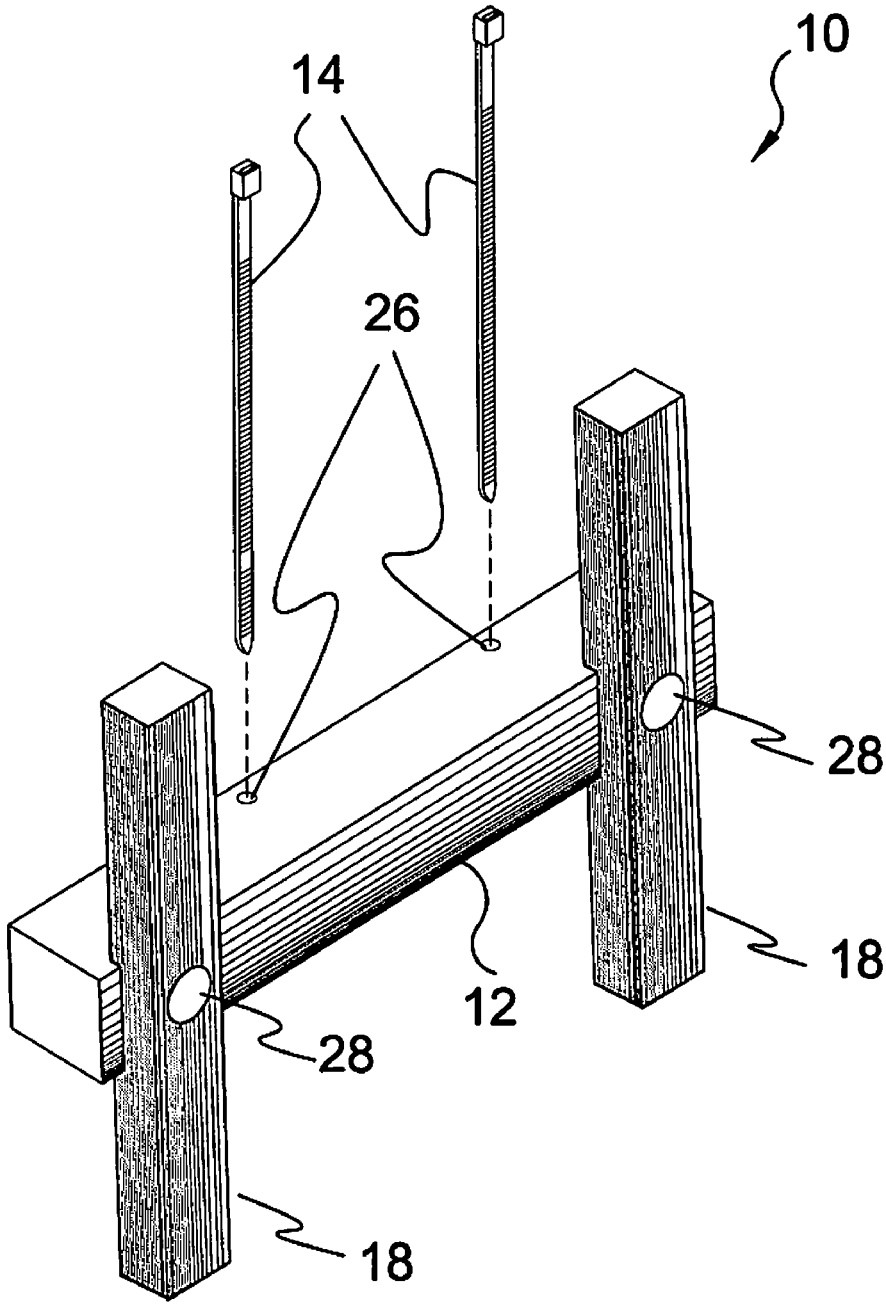
FIG. 2 is a perspective view of the present invention.

FIG. 1 is an illustrative view of the present invention 10 in use. The present invention is a child safety lock 10 for cabinetry comprising a bar forming a base standoff 12 with tie wrap straps 14 for non-invasively mounting the lock 10 to a cabinet frame 16. The standoff 12 has at least one rotative locking member 18 mounted thereon for impeding the opening of one or more cabinet drawers 20 and/or doors 22 with the standoff 12 having frictional means for holding the locking member 18 in a predetermined position. Shown is a child 24 unable to compromise the integrity of the child safety lock 10. Two variations of the present invention 10 are demonstrated in the illustration, one version utilizes a single locking member 18 and is used for adjacent cabinet doors 22 and the other implements a pair of locking members 18 for adjacent door 22 and drawer 20 combinations FIG. 2 is a perspective view of the present invention 10. The present invention 10 comprises a base standoff 12 that attaches to the cabinet frame 16 with two tie wraps 14 passing through apertures 26 extending therethrough, and either one or two rotative locking members 18 (depending on the type of cabinet). Each locking member 18 is rotatively secured to the base standoff 12 via a spring loaded pivot point 28.

Figure 3:
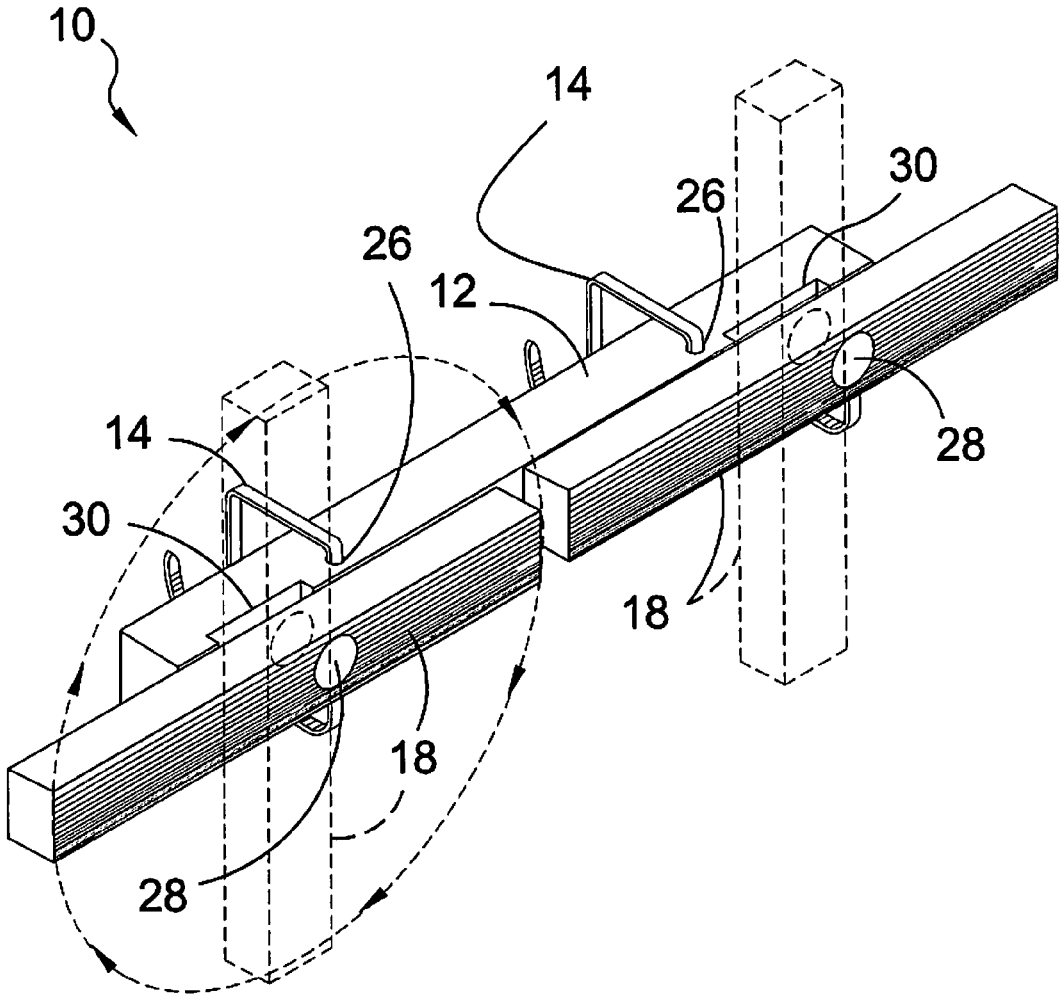
FIG. 3 is a perspective view of the present invention.

FIG. 3 is a perspective view of the present invention 10. Shown is the child safety lock 10 comprising a base standoff 12 with strap means 14 passing through apertures 26 disposed therein for non-invasively mounting to a cabinet frame and having at least one rotative locking member 18 mounted thereon for impeding the opening of one or more drawers and/or doors. The base standoff 12 has a spring-loaded pivot point 28 for holding the locking member 18 in a predetermined position. The locking members 18 are retained within notched sections 30 of the base standoff 12 when in perpendicular relation therewith. Shown is the present invention 10 in the open position with the locking members 18 parallel with the base standoff 12. The arrows indicate the movement of the locking members 18 to secure the drawers/doors by simply rotating them to the perpendicular position for alignment with their respective retaining notches 30 as depicted in dotted line. The locking members 18 may be rotated either clockwise or counterclockwise to achieve the desired position.

Figure 4:
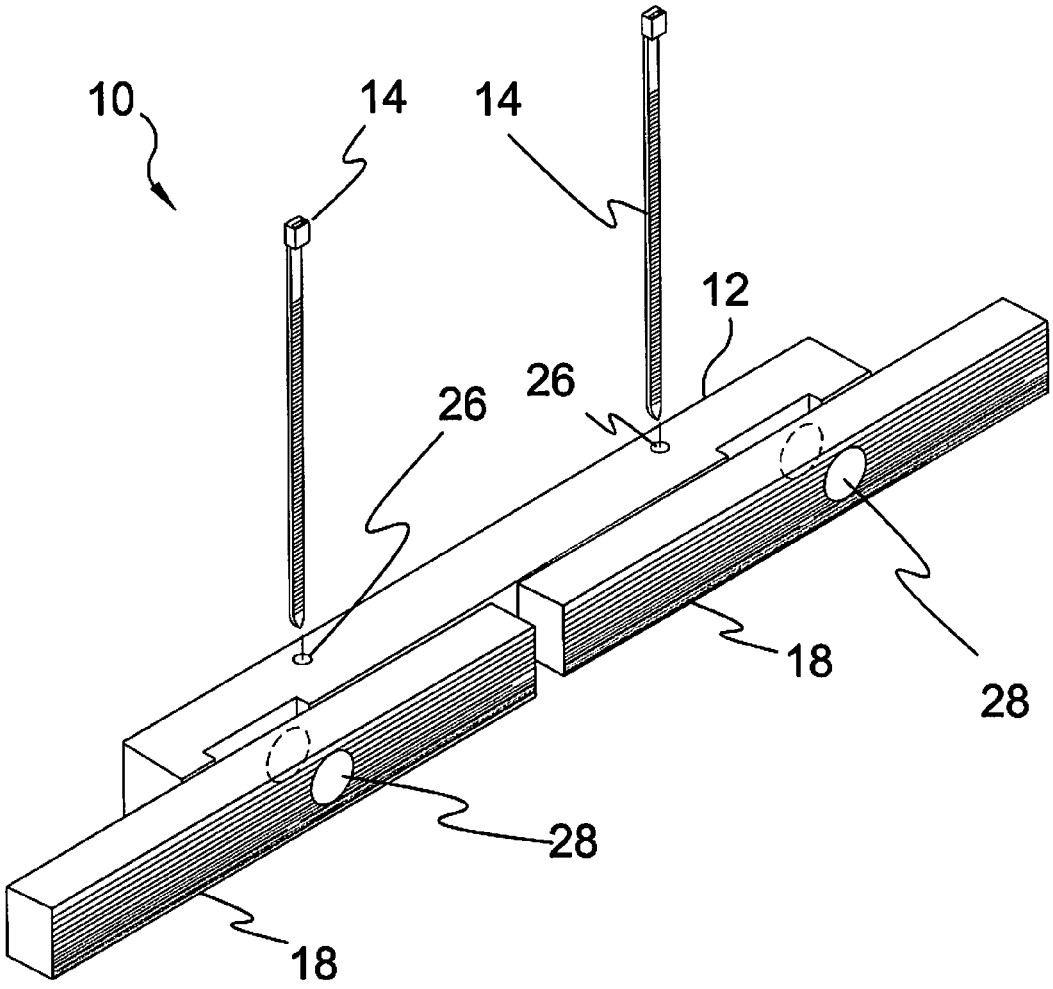
FIG. 4 is a perspective view of the present invention.

FIG. 4 is a perspective view of the present invention 10. Shown is the present invention 10 with rotative locking members 18 in an unlocked position with tie wrap straps 14 shown above each mounting aperture 26 of the base standoff 12. The spring-loaded pivot point 28 provides a bias urging the locking member 18 against the base standoff 12 where it remains frictionally engaged until rotated by the user.

Figure 5:
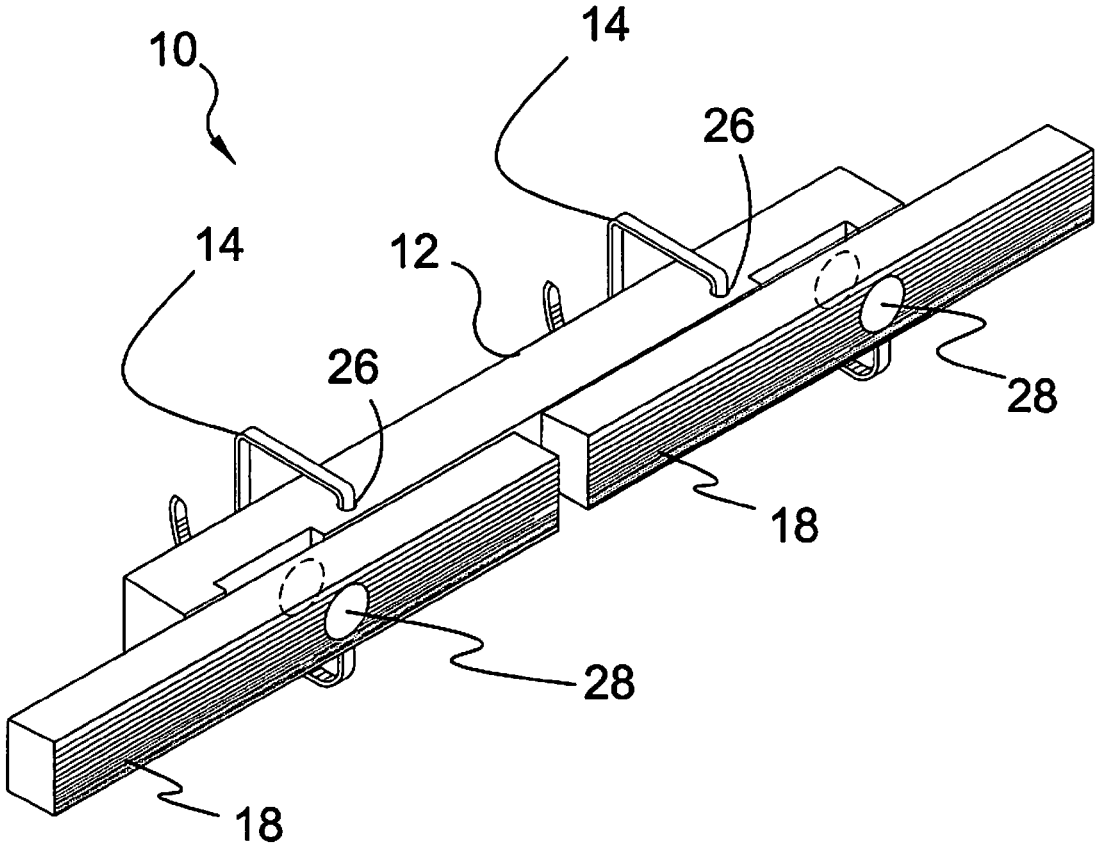
FIG. 5 is a perspective view of the present invention.

FIG. 5 is a perspective view of the present invention 10. Shown is the present invention 10 with rotative locking members 18 in an unlocked position with tie wrap straps 14 inserted through each mounting aperture 26 of the base standoff 12. The spring-loaded pivot point 28 provides a bias urging the locking member 18 against the base standoff 12 where it remains frictionally engaged until rotated by the user.

Figure 6:
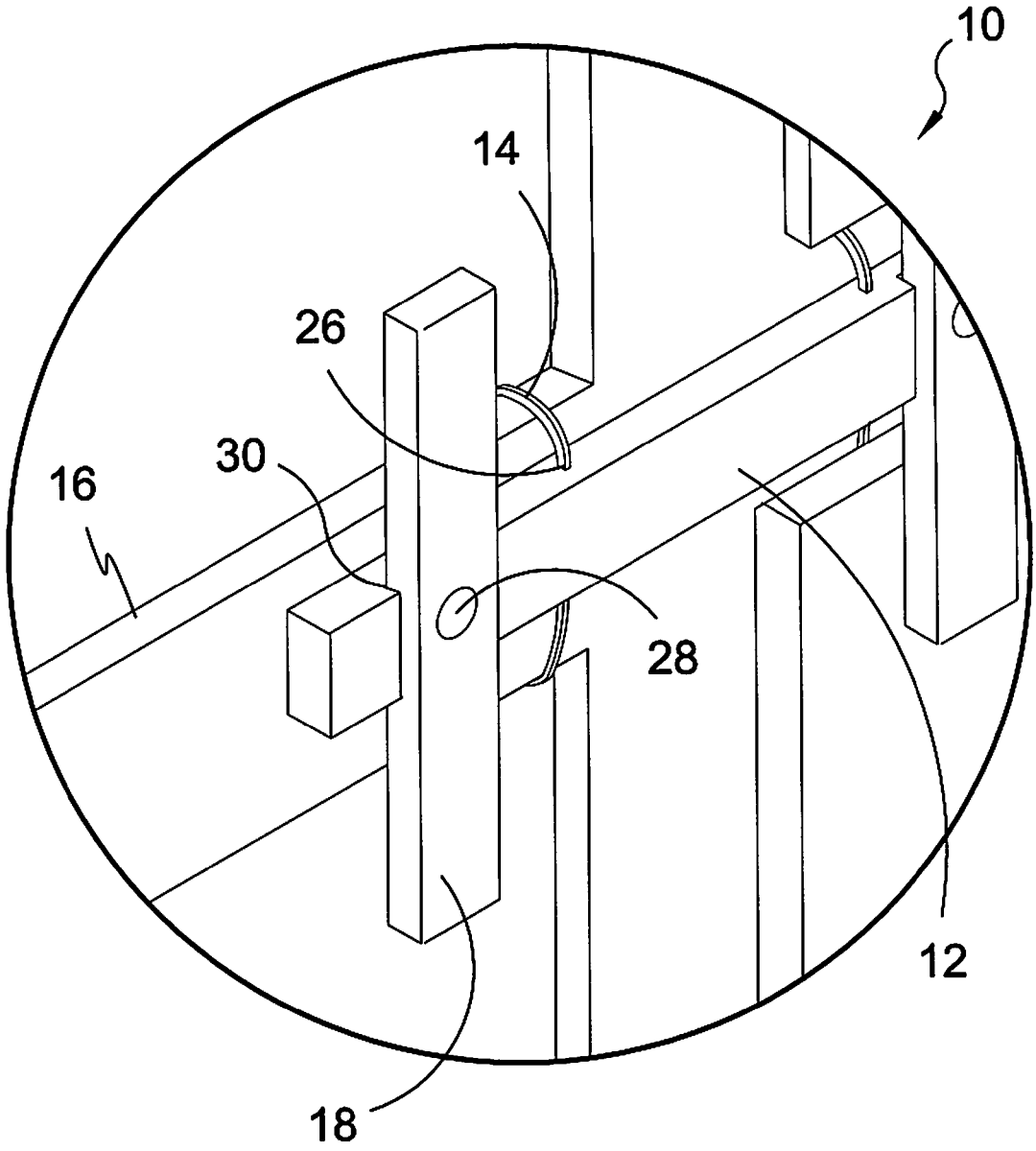
FIG. 6 is a detailed view of the present invention.

FIG. 6 is a detailed view of the present invention 10. Shown is a detailed view of the present invention 10 having a base standoff 12 that attaches to the cabinet frame 16 with two tie wraps 14, and either one or two rotative locking members 18 (depending on the type of cabinet). Also shown is the locking member 18 retained within the notch 30 by the spring-loaded pivot point 28 although the drawer has been removed and the cabinet door opened for clarity in illustrating the ease and simplicity of the installation process.

Figure 7:
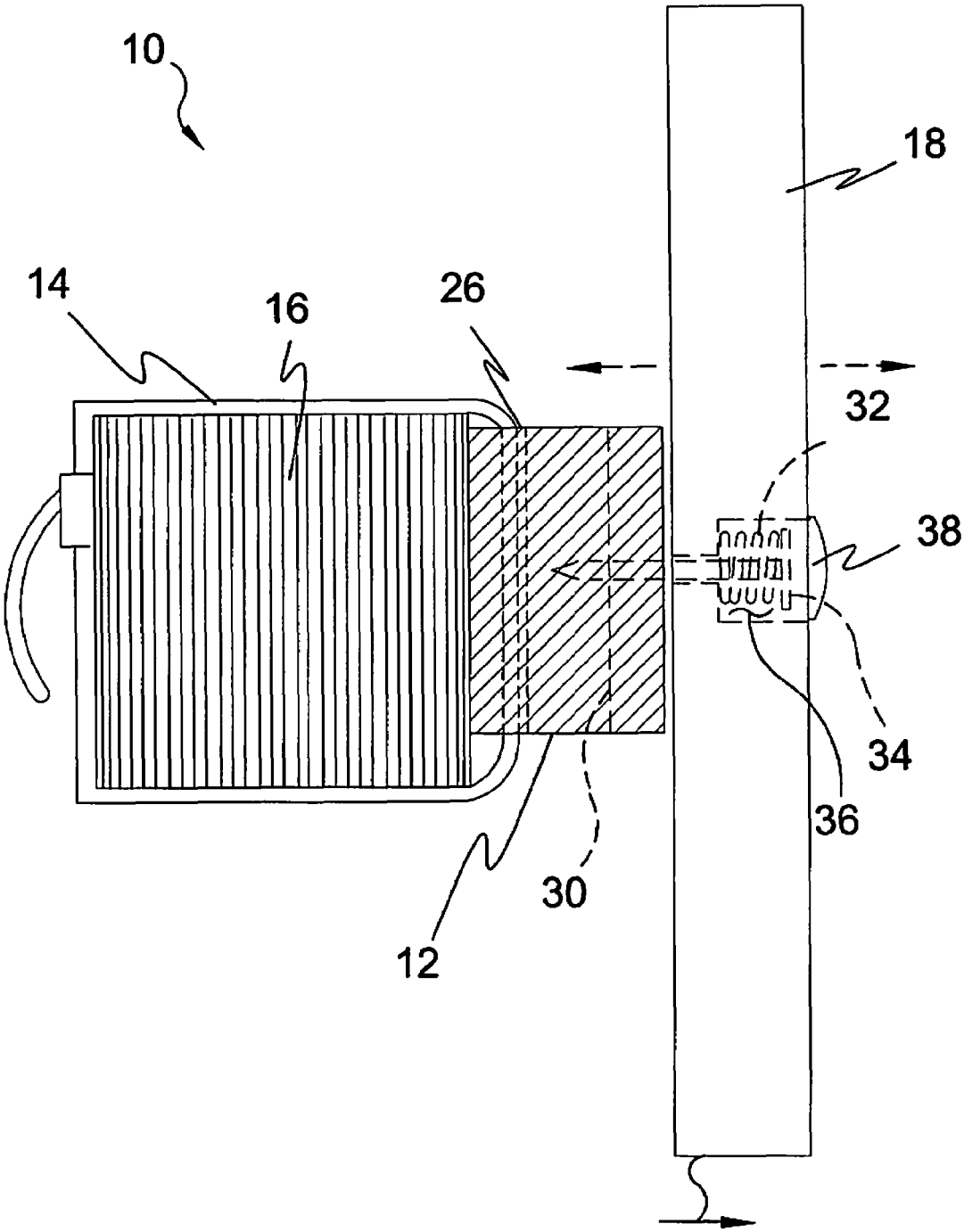
FIG. 7 is a sectional view of the present invention.

FIG. 7 is a sectional view of the present invention 10. Shown is a sectional view of the base standoff 12 secured to the cabinet frame 16 with tie wraps 14 and a locking member 18 withdrawn to clear the notch 30. A tensioning mechanism is used at the pivot points 28, in this case illustrated as a spring 32 and screw 34 within a recess 36 of the base standoff 12 although other suitable means may be employed that would achieve the objective. A cap 38 is provided to cover the external portion of the recess 36 for aesthetic purposes. The spring-loaded pivot point 28 provides a bias urging and retaining the locking member 18 into the notch 30 until pulled away therefrom to clear the surface of the base standoff 12 and rotated until parallel therewith to allow for the unimpeded opening of its respective doors or drawers.

Figure 8:
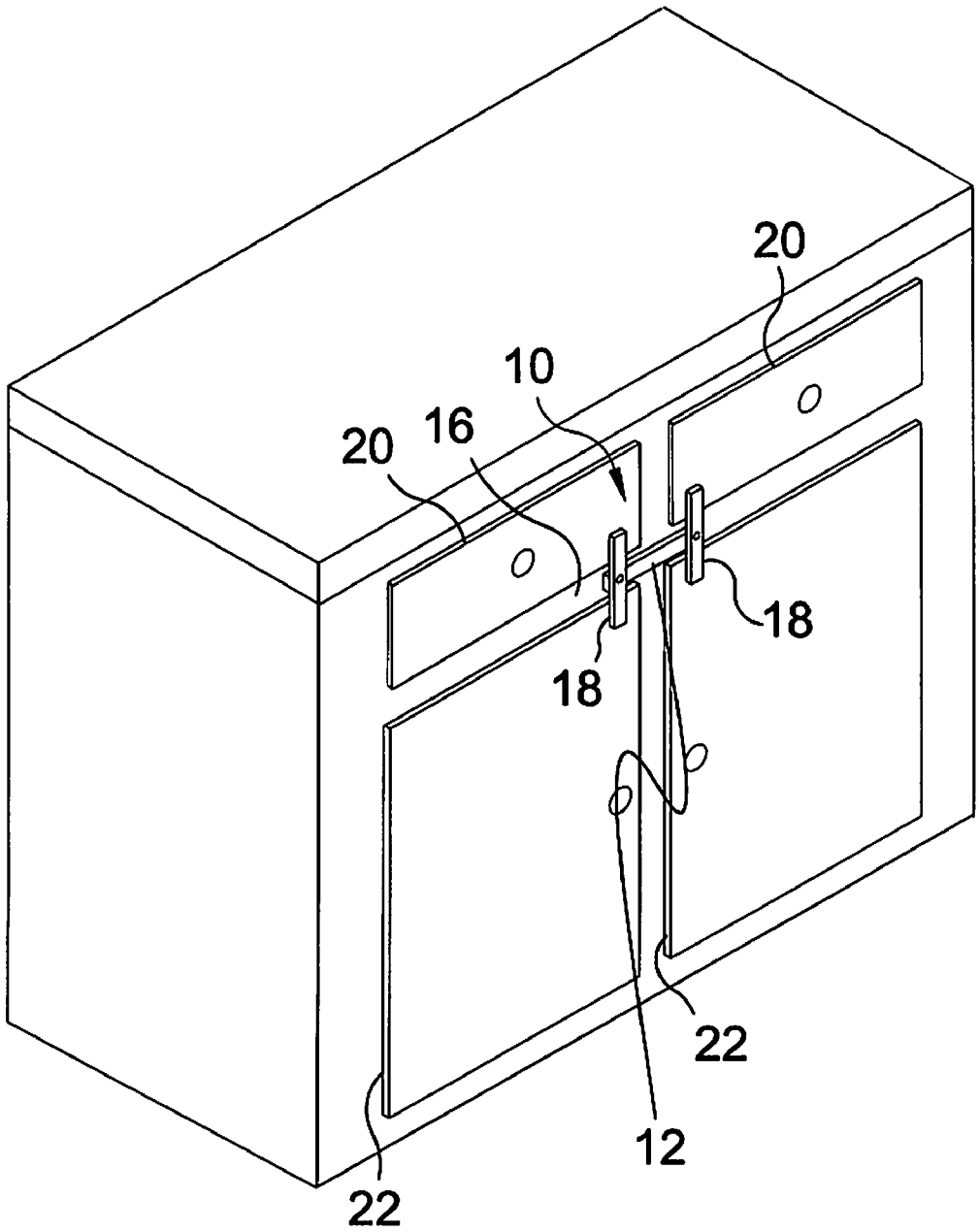
FIG. 8 is a perspective view of the present invention in a locked position.

FIG. 8 is a perspective view of the present invention 10 in a locked position. Shown is the base standoff 12 secured to the cabinet frame 16 and both locking members 18 locked in perpendicular relation therewith to impede any movement of their respective doors 22 and drawers 20.

Figure 9:
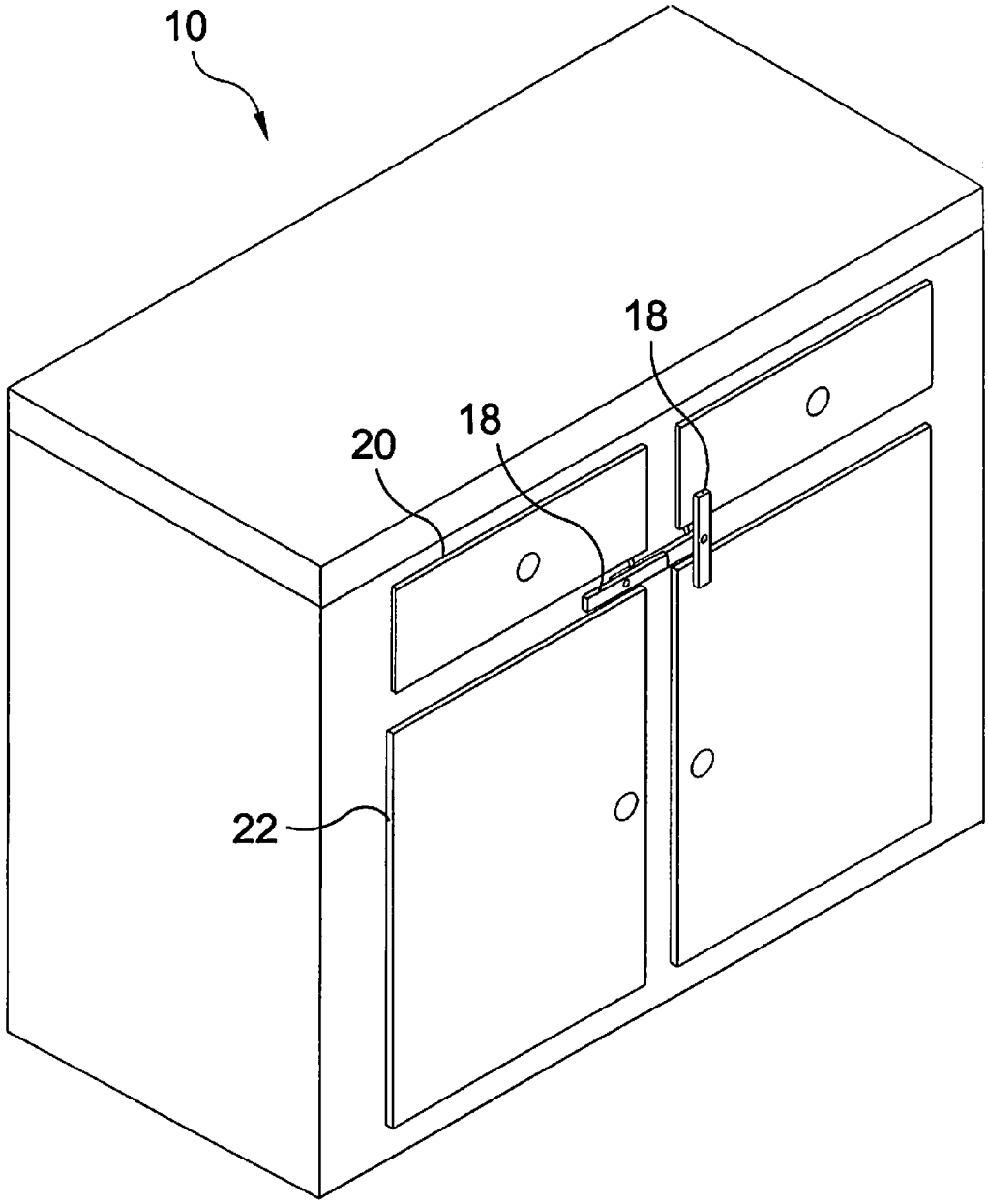
FIG. 9 is A perspective view of the present invention in a partially locked position.

FIG. 9 is a perspective view of the present invention 10 in a partially locked position. Shown is one locking member 18 in the open parallel position to provide access to its respective drawer 20 and door 22 with the other locking member 18 in the secure perpendicular position.

Figure 10:
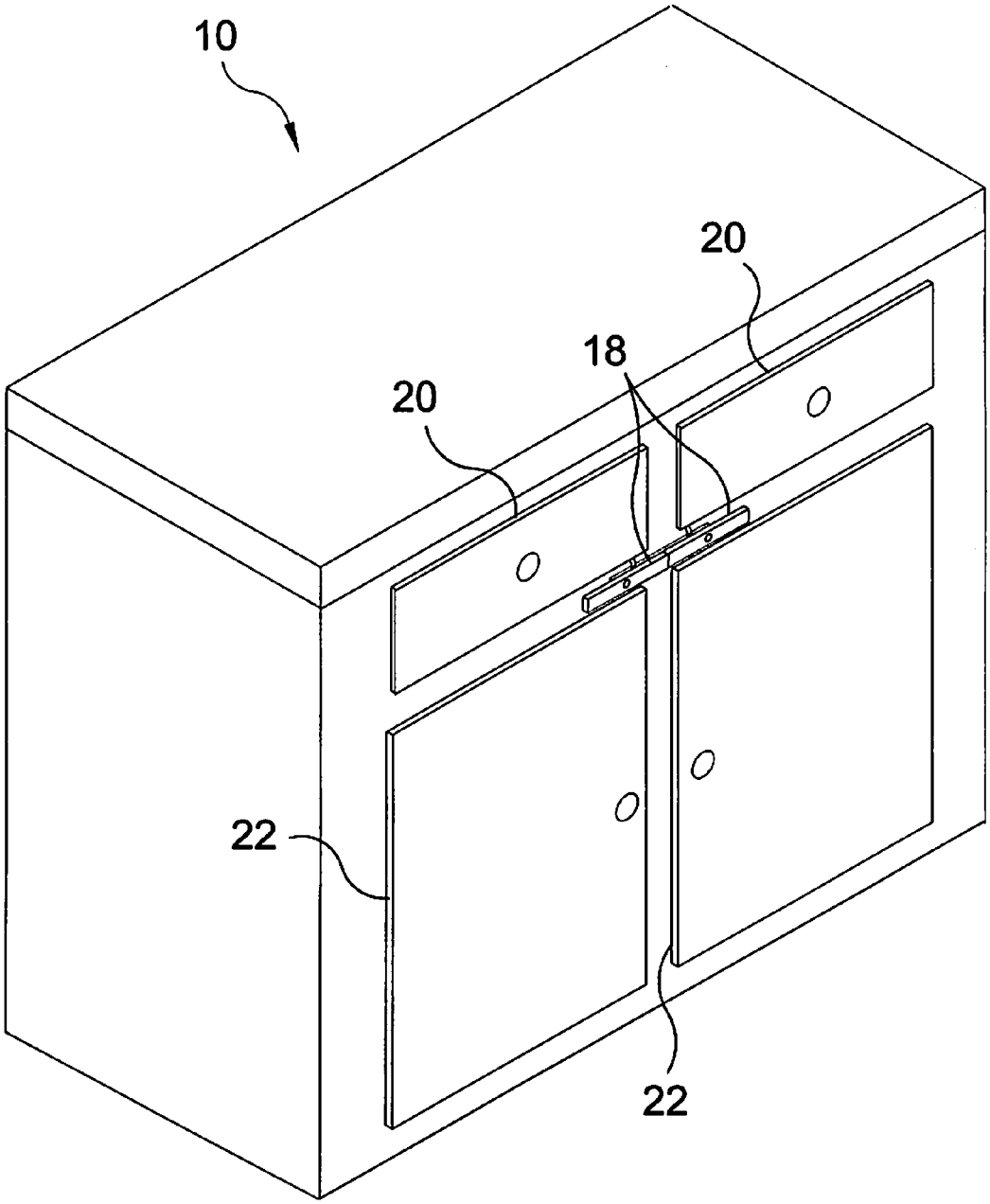
FIG. 10 is a perspective view of the present invention in an unlocked position.

FIG. 10 is a perspective view of the present invention 10 with both locking members 18 in the open parallel position. Shown are both locking members 18 rotated into the parallel position thereby providing unimpeded access to their respective doors 22 and drawers 24.

What is claimed is:

1. A safety lock for cabinet doors and drawers that is easily installed and removed without the need of drilling hopes or otherwise compromising the cabinetry, said safety lock comprising:

an elongate base standoff, wherein said base standoff is configured to be secured to a cabinet frame;

at least one locking member rotatively engaged with said base standoff;

said at least one locking member being rotatable between a locking position and an unlocking position, wherein, in the locking position, the at least one locking member extends from the elongate base standoff in two directions;

two tie-wraps introduced through two apertures for securing said base standoff to the cabinet frame;

wherein said base standoff further includes a notch associated with each of said at least one locking member for retaining the respective locking member in the locking position;

wherein each notch has a width that will allow it to receive its respective locking member when aligned therewith;

a spring-loaded pivot-point for engaging said at least one locking member to said base standoff;

wherein when a respective one of said at least one locking member is rotated to the locking position, the locking member is retained in its respective notch by its respective spring-loaded pivot-point; and wherein when a respective one of said at least one locking member is moved out of its respective notch and rotated to the unlocking position it is retained in a position parallel to the base standoff by its respective spring-loaded pivot point.

2. The safety lock of claim 1, wherein each of said at least one locking member includes a recess wherein said pivot point is disposed.

3. The child safety lock of claim 2, wherein each said recess extends substantially through said at least one locking member opposite said base standoff and wherein a diameter of the recess decreases as it extends through the at least one locking member.

4. The safety lock of claim 3, wherein said pivot point further includes a screw inserted through said recess of said base standoff and threaded at least partially into said base standoff leaving a gap between a head of said screw and a point at which the diameter of said recess decreases.

5. The safety lock of claim 4, wherein a spring member is disposed around said screw in the gap between the head of thereof and the point at which the diameter of said recess decreases.

6. The safety lock of claim 5, wherein said spring provides a bias urging said locking member against said base standoff.

7. A safety lock for cabinet doors and drawers that is easily installed and removed without the need of drilling holes of otherwise compromising the cabinetry, said safety lock comprising:

an elongate base standoff, wherein said base standoff is configured to be secured to a cabinet frame;

at least one locking member rotatively engaged with said base standoff said at least one locking member being rotatable between a locking position and an unlocking position, wherein, in the locking position, the at least one locking member extends from the elongate base standoff in two directions;

two tie-wraps introduced through two apertures for securing said base standoff to the cabinet frame; and a spring-loaded pivot point for engaging said locking member to said base standoff;

wherein each of said at least one locking member includes a recess within which said pivot point is disposed;

wherein each said recess extends substantially through its respective locking member opposite said base standoff and terminates with a substantially smaller diameter as it extends through the locking member;

wherein said pivot point further includes a screw extending through said recess and threaded at least partially into said base standoff leaving a gap between a head of said screw and a point at which the diameter of said recess decreases;

wherein a spring member is disposed around said screw in the gap between the head thereof and the point at which the diameter of said recess decreases;

wherein said base standoff further includes a notch associated with each of said at least one locking member for retaining the respective locking member in the locking position and each notch has a width that will allow it to receive its respective locking member when aligned therewith;

wherein when a respective one of said at least one locking member is rotated to the locking position, the locking member is retained in its respective notch by its respective spring; and wherein when a respective one of said at least one locking member is moved out of its respective notch and rotated to the unlocking position it is retained in a position parallel to the base standoff by its respective spring.

8. The safety lock of claim 7, wherein said screw is embedded generally centrally within said notched section.

9. The safety lock of claim 7, wherein said screw is embedded centrally within said notched section.

* * * * *